US009840880B2

(12) United States Patent
Hansen et al.

(10) Patent No.: US 9,840,880 B2
(45) **Date of Patent: *Dec. 12, 2017**

(54) CASING CENTRALIZER

(71) Applicants: Summit Energy Services, Inc., Fort Worth, TX (US); Jody D. Riddle, Aurora, IL (US); Jeffrey Scott Danielson, Elgin, IL (US)

(72) Inventors: Mitchel D. Hansen, Aledo, TX (US); Andrew M. Eldridge, Fort Worth, TX (US); Jody D. Riddle, Aurora, IL (US); Jeffrey Scott Danielson, Elgin, IL (US)

(73) Assignee: SUMMIT CASING SERVICES, LLC, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/243,749

(22) Filed: Aug. 22, 2016

(65) Prior Publication Data

US 2016/0356100 A1 Dec. 8, 2016

Related U.S. Application Data

(63) Continuation of application No. 14/738,697, filed on Jun. 12, 2015, now Pat. No. 9,422,774, which is a continuation of application No. 13/873,004, filed on Apr. 29, 2013, now Pat. No. 8,701,759, which is a continuation of application No. 13/803,088, filed on Mar. 14, 2013, now Pat. No. 9,057,229.

(51) Int. Cl.
*E21B 17/10* (2006.01)
*E21B 19/24* (2006.01)

(52) U.S. Cl.
CPC ..... *E21B 17/1078* (2013.01); *E21B 17/10* (2013.01); *E21B 17/1042* (2013.01); *E21B 19/24* (2013.01)

(58) Field of Classification Search
CPC ..... E21B 17/1078; E21B 19/24; E21B 17/10; E21B 17/1042
See application file for complete search history.

(56) References Cited

U.S. PATENT DOCUMENTS 8,701,759 B1 * 4/2014 Hansen ..... E21B 17/10 166/241.1

* cited by examiner

*Primary Examiner* — Yong-Suk (Philip) Ro
(74) *Attorney, Agent, or Firm* — Jackson Walker LLP; Christopher J. Rourk; Blake T. Dietrich

(57) ABSTRACT

A casing centralizer comprising a cylindrical base and a plurality of blades extending from the cylindrical base. The plurality of blades and the cylindrical base are compression molded as a single piece from a mineral filled, glass and specialty fiber reinforced polyester molding compound.

18 Claims, 2 Drawing Sheets

CASING CENTRALIZER

RELATED APPLICATIONS

The present application is a continuation of U.S. patent application Ser. No. 14/738,697, filed Jun. 12, 2015, now U.S. Pat. No. 9,422,774; which is a continuation of U.S. patent application Ser. No. 13/873,004, filed Apr. 29, 2013, now U.S. Pat. No. 8,701,759; which is a continuation of U.S. patent application Ser. No. 13/803,088, filed Mar. 14, 2013, now U.S. Pat. No. 9,057,229, which is hereby incorporated by reference for all purposes as if set forth herein in its entirety.

TECHNICAL FIELD

The present application relates to casing centralizers, and more specifically to a casing centralizer with improved material properties that is formed by compression molding a bulk molding compound.

BACKGROUND OF THE INVENTION

Non-metallic casing centralizers for use in casing oil and gas wells are known in the art, but suffer from material deficiencies that render them unacceptable for the downhole environment where they are used. The material properties required for such applications are not defined.

SUMMARY OF THE INVENTION

A casing centralizer is provided that includes a cylindrical base and a plurality of blades extending from the cylindrical base, wherein the plurality of blades and the cylindrical base are compression molded as a single piece from a mineral filled, glass and specialty fiber reinforced polyester molding compound, such as ST-20250 (Bulk Molding Compounds, Inc., West Chicago, Ill.).

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
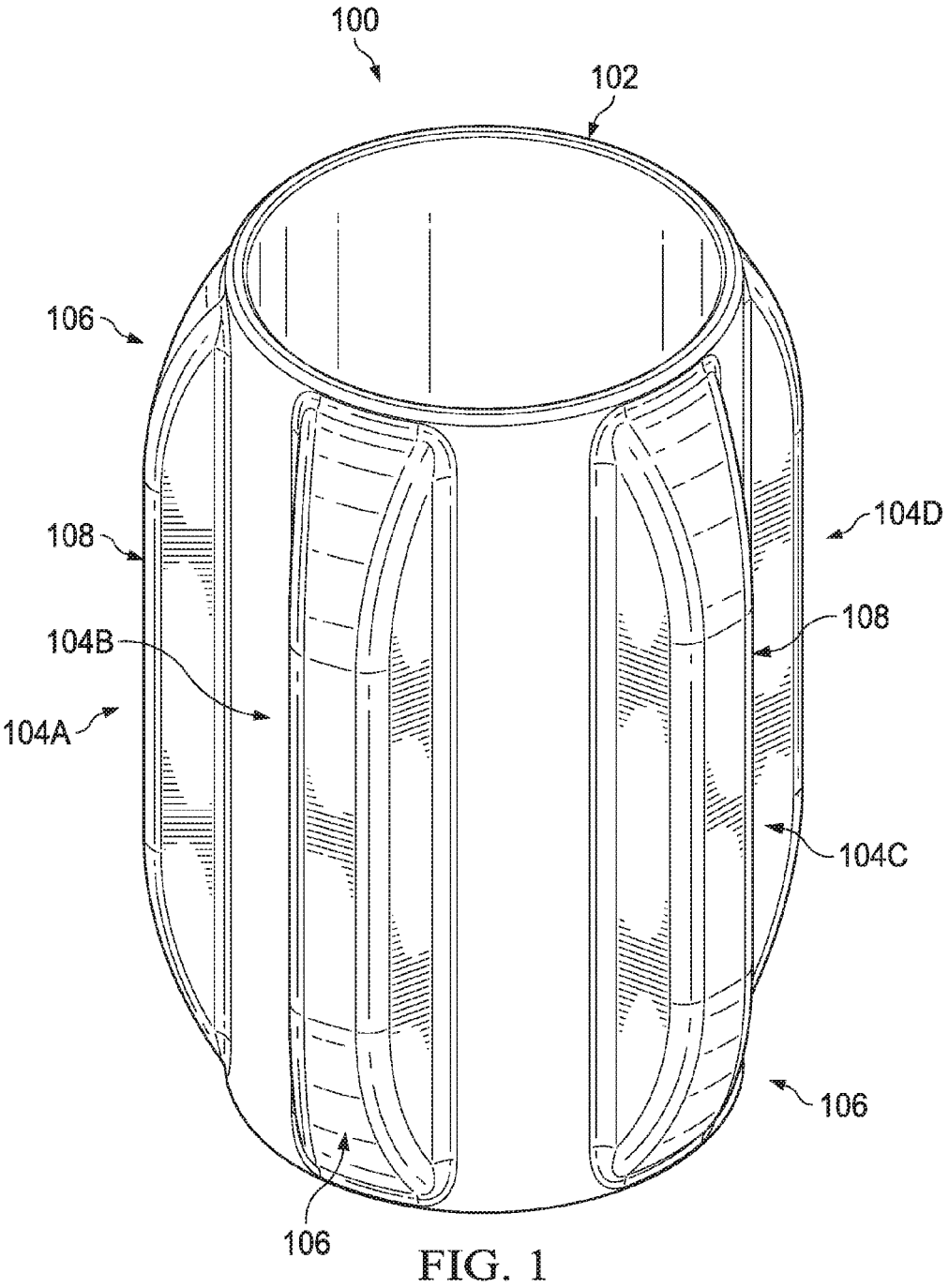
FIG. 1 is a diagram of a casing centralizer in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a casing centralizer 100 in accordance with an exemplary embodiment of the present disclosure. Casing centralizer 100 includes a cylindrical base 102 that fits around the well casing that is to be centralized within a bore hole, and has five straight blades 104A through 104E (of which four are shown) that are used to centralize the well casing in the bore hole with the casing centralizer. Each blade has a curved slope 106 from the base 102 to the top of the blade as opposed to a step, in order to avoid creating any surfaces that can get caught on discontinuities in the bore hole. Each blade also includes a flat portion 108 along the top of the blade, where flat portion 108 is in contact with the bore hole as the section of casing on which casing centralizer 100 is deployed is moved down the bore hole. Likewise, a multiple part base, a base that has a non-uniform cross-section, a greater or lesser number of blades, blades having a different shape or other suitable configurations can be used for the base or blades.

Casing centralizer 100 is compression molded using a bulk molding compound, unlike prior art non-metallic centralizers that are injection molded or extruded. Compression molding using a bulk molding compound allows casing centralizer 100 to have superior material properties for use within the harsh environment that casing centralizers are exposed to in oil and gas wells. In one exemplary embodiment, the bulk molding compound can be a mineral filled, glass and specialty fiber reinforced polyester molding compound suitable for compression and stuffer injection molding.

Typical properties for the molding operation can include a temperature of 270 to 370° F., with mold shrinkage of 0.001 to 0.004 mil/in, and a molded specific gravity of 1.65 to 1.95. The mechanical/physical properties of the bulk molding compound that make centralizer 100 suitable for use in oil and gas wells include a flexural strength of 18,000 to 28,000 psi, a flexural modulus of 1.4 to $2.2*10^6$ psi, a tensile strength of 5,000 to 12,000 psi, a compressive strength of 18,000 to 28,000 psi, an impact strength, notched Izod, of 6 to 14 ft-lb/in and a shear strength of 2,800 to 6,800 psi. The electrical properties include an arc resistance of greater than 180 seconds, a comparative tracking index of greater than 600 volts, and a short time dielectric strength of 325 to 425 volts/mil. The thermal properties include a heat deflection temperature at 264 psi of greater than 450° F.

In one exemplary embodiment, the unsaturated polyester bulk molding compound can be formed by combining 31% resin system with 37.5% filler System and 31.5% chopped strand reinforcement. The molding process can include using a 400 ton press for compression molding, with temperatures of 300 to 330° F. and less than 10 minutes for the cure cycle. In another exemplary embodiment, the unsaturated polyester bulk molding compound can comprise a suitable combination of the following: <17% styrene; (10% vinyl toluene; <20% unsaturated polyester; <2% zinc stearate; <2% divinyl benzene; <70% calcium carbonate; <70% alumina trihydrate; <29% kaolin; <2% calcium stearate; <65% calcium metasilicate; <35% fibrous glass; <2% zinc sulfide; <2% iron oxide black; <3% carbon black; <4% titanium dioxide; <4% polyethylene; <3% talc and <5% polystyrene. In another exemplary embodiment, casing centralizer 100 can be made from ST-20250, available from Bulk Molding Compounds, Inc., 1600 Powis Court, West Chicago, Ill. 60185.

Figure 2:
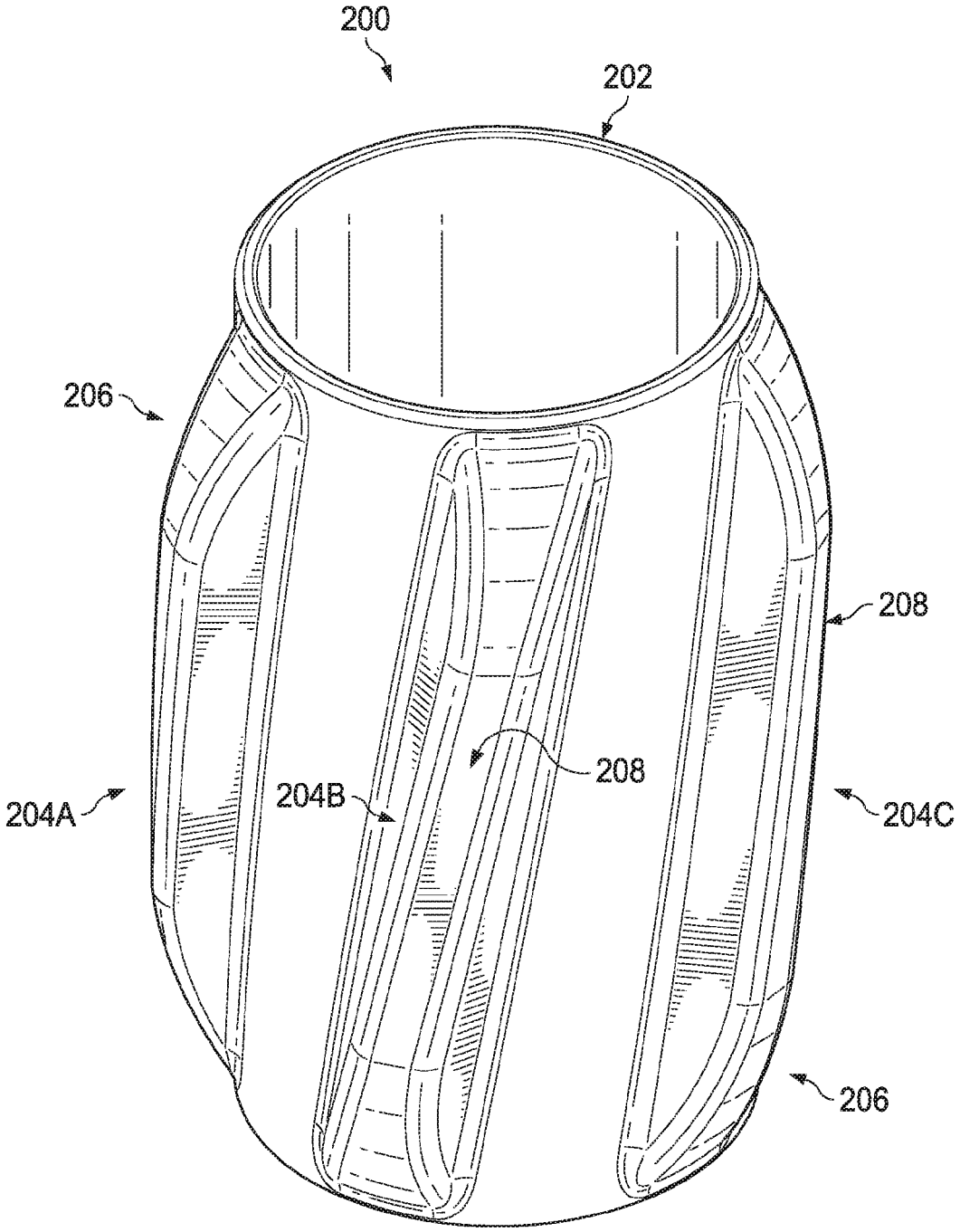
FIG. 2 is a diagram of a casing centralizer with curved blades in accordance with an exemplary embodiment of the present disclosure.

FIG. 2 is a diagram of a casing centralizer 200 with curved blades in accordance with an exemplary embodiment of the present disclosure. Casing centralizer 200 includes cylindrical base 202 and five curved blades 204A through 204E (of which three are shown). Each blade also includes a curved transition 206 from the base 202 to the top of the blade, and a flat segment 208 that will be in contact with the bore hole as the casing section with casing centralizer 200 is move down the bore hole. Casing centralizer 200 can be made from the same material as casing centralizer 100 or other suitable materials.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A casing centralizer comprising:

a cylindrical base;

a plurality of blades extending from the cylindrical base, wherein the plurality of blades and the cylindrical base are compression molded as a single piece from a mineral filled, glass and specialty fiber reinforced polyester molding compound, and wherein the mineral filled, glass and specialty fiber reinforced polyester molding compound comprises a combination of styrene, kaolin, calcium stearate, calcium metasilicate, fibrous glass, and polystyrene.

2. The casing centralizer of claim 1 wherein the mineral filled, glass and specialty fiber reinforced polyester molding compound has a flexural strength of 18,000 to 28,000 psi.

3. The casing centralizer of claim 1 wherein the mineral filled, glass and specialty fiber reinforced polyester molding compound has a flexural strength of 18,000 to 28,000 psi.

4. The casing centralizer of claim 1 wherein one or more of blades comprises a flat portion along a top of the blade.

5. The casing centralizer of claim 1 wherein one or more of blades comprises a flat portion along a top of the blade and a curved slope extending from the cylindrical base to the top of the blade.

6. The casing centralizer of claim 1 wherein one or more of blades is straight in a straight axial direction.

7. The casing centralizer of claim 1 wherein one or more of blades is curved in a axial direction.

8. The casing centralizer of claim 1 wherein one or more of blades has at least one flat side.

9. The casing centralizer of claim 1 wherein one or more of blades has a curved transition between a top surface and a side surface.

10. The casing centralizer of claim 1 wherein one or more of blades has a curved transition between a side surface and the cylindrical base.

11. A casing centralizer comprising:

a cylindrical base;

a plurality of blades extending from the cylindrical base, wherein the plurality of blades and the cylindrical base are compression molded as a single piece from a mineral filled, glass and specialty fiber reinforced polyester molding compound, and wherein the mineral filled, glass and specialty fiber reinforced polyester molding compound comprises a combination of styrene, calcium metasilicate, and fibrous glass.

12. The casing centralizer of claim 11 wherein one or more of blades comprises a flat portion along a top of the blade.

13. The casing centralizer of claim 11 wherein one or more of blades comprises a flat portion along a top of the blade and a curved slope extending from the cylindrical base to the top of the blade.

14. The casing centralizer of claim 11 wherein one or more of blades is straight in a straight axial direction.

15. The casing centralizer of claim 11 wherein one or more of blades is curved in a axial direction.

16. The casing centralizer of claim 11 wherein one or more of blades has at least one flat side.

17. The casing centralizer of claim 11 wherein one or more of blades has a curved transition between a top surface and a side surface.

18. The casing centralizer of claim 11 wherein one or more of blades has a curved transition between a side surface and the cylindrical base.

* * * * *